United States Patent [19]

Buerkert et al.

[11] 4,250,619

[45] Feb. 17, 1981

[54] PINKING SCISSORS WITH REPLACEABLE BLADES

[76] Inventors: Antoinette P. Buerkert, 9801 Honey Cut La., St. Louis, Mo. 63119; George T. Hughes, 2327 Ravensgate, St. Louis, Mo. 63131

[21] Appl. No.: 2,109

[22] Filed: Jan. 8, 1979

Related U.S. Application Data

[63] Continuation-in-part of Ser. No. 851,455, Nov. 14, 1977, abandoned.

[51] Int. Cl.[3] ..... B26B 13/10

[52] U.S. Cl. ..... 30/230; 30/260

[58] Field of Search ..... 30/178, 229, 230, 260

[56] References Cited

U.S. PATENT DOCUMENTS

| | | | |
|---|---|---|---|
| 489,406 | 1/1893 | Austin | 30/230 |
| 1,470,417 | 10/1923 | Wintle | 30/260 |
| 1,645,035 | 10/1927 | Zeidler | 30/260 |
| 2,564,537 | 8/1951 | Lincoln | 30/230 |

*Primary Examiner*—Jimmy C. Peters

*Attorney, Agent, or Firm*—Glenn K. Robbins

[57] ABSTRACT

Pinking scissors having replaceable cutting blades. The replaceable cutting blades have different edges to provide different types of pinking designs such as scallops, triangular sections, rectangular edges and the like. The replaceable blades are of rigid L-shaped construction one side serving as a base fitting against the supporting stem of the scissors and the other side having a cutting edge. Stop means are provided for registry on the supporting stems which are bifurcated and spaced apart to provide for easy reception of the replaceable blades. A special feature resides in the provision of a reversible cutting blade with both edges of the L-shaped sections having a pinking cutting edge. When not in use one section with the pinking edge serves as a base and when desired to provide a different design the blade may be removed and reversed with the unused portion serving as cutting edge and the section previously serving as a cutting edge used as a base fitting against the support stems.

8 Claims, 14 Drawing Figures

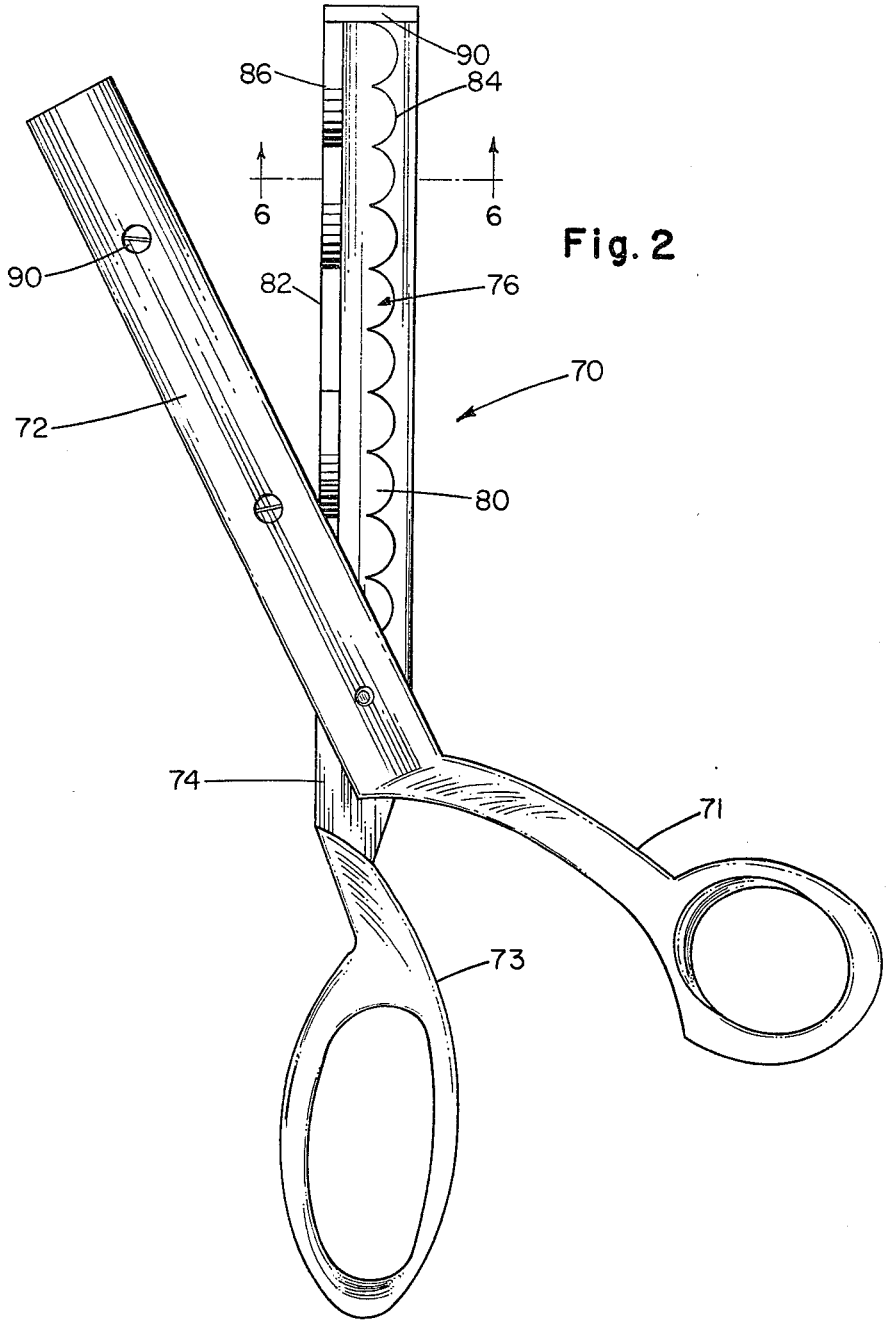
Fig. 2
Fig. 3
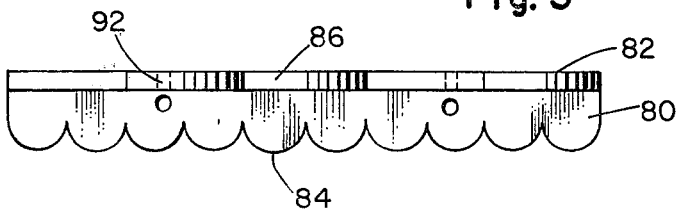

PINKING SCISSORS WITH REPLACEABLE BLADES

RELATED APPLICATION

This application is a continuation in part of our copending application Ser. No. 851,455 filed Nov. 14, 1977, now abandoned.

BACKGROUND OF THE INVENTION

The present invention relates to scissors-type cutting tools commonly known as pinking scissors with interchangeable cutting blades. Ordinarily, cutting tools, such as scissors, come equipped with a pair of handles or hand grips and with a pair of blades or opposite cutting edges that work against one another about a common fulcrum. A cutting tool or pair of scissors may have permanently attached or removable blades. The cutting edges of scissors usually make a straight-line cut on a work material or fabric. In the case of pinking cutters or shears, which are actually scissors with saw-toothed cutting edges, they give the work material of fabric a zigzag line of scalloped edge (commonly known in the trade as a "pinked edge"), which keeps the thread of the material or fabric from ravelling. Prior to this invention, however, those scissors having interchangeable cutting blades provided only for replacement of a blade with one having the same cutting edge design (either "pinked edge" or straight line) as the blade being replaced. The purpose of this feature was to replace worn out blades.

SUMMARY OF THE INVENTION

The instant invention is directed to an improved scissors-type cutting device commonly known as pinking scissors.

The cutting device of this invention is provided with a pair of cutting-blade support stems, each such stem having a handle at one end portion thereof. The stems are pivotally connected together in a conventional manner, and spaced apart so as to permit acceptance of a pair of matching cutting blades on the other end portions of such stems. Conventional means such as screws are also provided for attaching pairs of matching cutting blades of various designs to the support stems, and for aligning them so as to permit the cutting edge of the blade carried by one stem to register with and fit closely into the cutting edge of the corresponding, matching blade carried by the other stem, when such stems are pivotally moved into and out of cutting relation with one another.

As a further feature of this invention support stems are constructed in a forked or bifurcated fashion so that they are spaced together a sufficient distance to receive the replaceable cutting blades. Stop means are provided on a portion of the support stem in the manner of a shoulder which is co-terminous with the support or base portion of the cutting blade. A further stop means, such as a flange at the end of the support stem, serves to properly position the pinking blades in proper registry with screw means provided to hold the blades to the support stem. In order to provide particular rigidity, the replaceable blades are of an L-shaped rigid construction so that one portion may serve as a flat base fitting flush against the support stem and hold the other portion rigidly upright from the base to serve as the cutting edge.

It is a further feature of this invention to provide a reversible pinking blade. The reversible pinking blade is of L-shaped construction and has separate pinking or cutting designs on the edges on both of the sections forming the L-shaped blade. The pinking edge designs may be semi-circular scallops of large and small radius, zigzag, rectangular, triangular or other appropriate cutting edges. A selected cutting design is provided at one edge of the L-shaped blade section while a companion or different design is provided at the other edge. The mating blade carried by the other support stem will appropriately be provided with a meshing design and also may be reversed in a like manner. The reversing is effected by turning the blade over and turning one end to form the bottom and the other end to form the top from the previous position. The previous cutting blade will then serve as a base and the previous base will serve as a cutting edge. By means of the reversible blade provision, two entirely different pinking designs may be provided by the same blade by simply taking the blade out from the support stem and reversing its position and performing the same operation on the other and matching blade on the opposite support stem.

It is an object of this invention to provide a reversible cutting blade of an L-shaped configuration having pinking cutting blades of different designs on the cutting edges of both of the sections forming the L-shaped construction.

It is a further object of this invention to provide a pair of pinking scissors having bifurcated stems which form a fork-like extension from a handle and spaced from one another to readily receive the removable pinking cutting blades. The above objects, as well as other objects and advantages, will become apparent from the following description when read in view of the accompanying drawings and will be otherwise apparent to those skilled in the art.

For the purpose of illustration of the invention herein, there is shown in the accompanying drawings a preferred embodiments thereof. It is to be understood that these drawings are for the purpose of example only and that the invention is not limited thereto.

IN THE DRAWINGS

FIG. 1*a*, is a view showing a pinking blade design with a semi-circular scallop.

FIG. 1*b*, is a view similar to FIG. 5*a*, showing a triangular scallop.

FIG. 1*c*, shows a rectangular scallop.

FIG. 1*d*, shows a zigzag scallop.

FIG. 1*e*, shows a sinusoidal scallop.

FIG. 1*f*, shows a wide angle triangular scallop.

FIG. 1*g*, shows a dovetail scallop.

FIG. 2, is a plan view showing a embodiment using removable and reversible scallop blades having two cutting edges.

FIG. 3, is a top plan view of the removable and reversible blade.

DESCRIPTION OF THE INVENTION

Figure 1A:
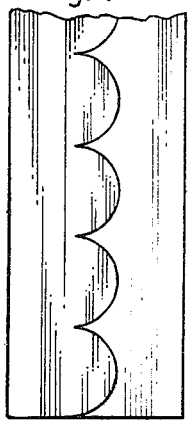
Figure 1B:
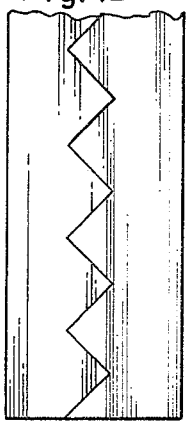
Figure 1C:
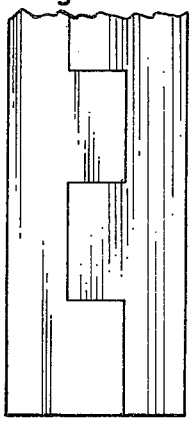
Figure 1D:
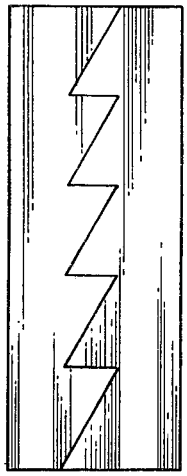
Figure 1E:
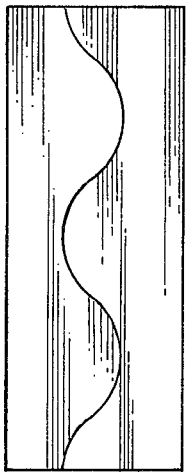
Figure 1F:
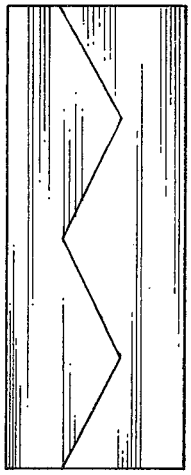
Figure 1G:
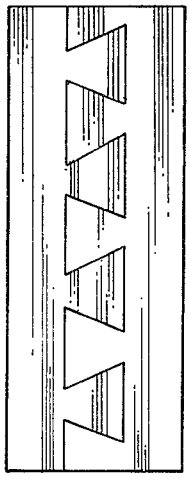

A variety of cutting blade designs are illustrated in FIGS. 1*c* through FIGS. 1*g*, including: a series of half-circles which are either contiguous or spaced apart (FIG. 1*a*), a series of rectangles which are spaced apart (FIG. 1*c*), a series of dovetail truncated cones which are spaced apart (FIG. 1*g*), a curvilinear or sinusoidal wave shape (FIG. 1*e*), a series of serrated zigzag shapes resembling the letter "Z" (FIG. 1*d*), and several serrated or triangular configurations (FIGS. 1*b* and 1*f*).

The cutting device of the present invention may be used to cut specific patterns or designs on the edge of sheet materials such as fabric, paper, thin food products, some plastics, and the like. A design edge can be used as a decorative trim on a craft item or as an edge that can be finished by being sewn around.

An embodiment of our invention for cutting device utilizing pinking edging is shown by reference numeral 70 in FIGS. 2 through 8. In this embodiment a replaceable pair of cutting blades is employed in which an L-shaped blade has separate pinking edges on both sides of each blade. The separate pinking or cutting edges may be of different design such as generally shown in FIGS. 1*a* through 1*g* or may even be the same design, as desired, to double the life of the blades for the same pinking design at the will of the user depending upon the blades utilized. In the cutting device 70 handles 71 and 73 are provided support stems 72 and 74, each support a reversible cutting blade 76 and 78 are connected to the handles. Each of the cutting blades is comprised of an L-shaped construction having what may be termed a base section 80 and a base section 82, since in the reversible function both sections may serve as bases fitting upon the stem. In the reversible blade, however, the function can be interchanged since both of the sections also have separate pinking edges 84 and 86. This is simply accomplished by turning the blade over and reversing it 180° so that what formerly was a base section becomes a cutting edge and vice-versa for the cutting edge now turned into the functional section.

Both of the replaceable blades 76 and 78 are secured to their respective supporting stems 72 and 74, by securing and positioning screws 90 which interfit through holes in the supporting stem to be attached to internally threaded openings in the back side of both sections 80 and 82 of the pinking blades depending upon which section is used as the base and which is used as the cutting edge.

Figure 7:
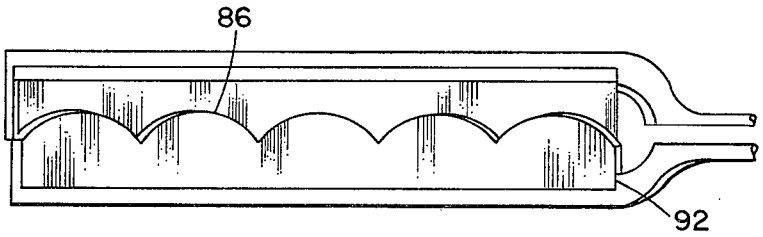
FIG. 7, is a view in side elevation showing the meshing of the reversible blades using the larger scallop design.
Figure 8:
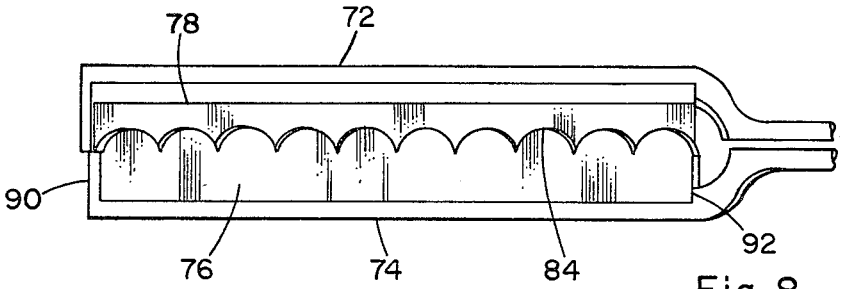
FIG. 8, is a view similar to FIG. 7, but showing the blade reversed to present the smaller scallop design in cutting relation.

For further aid in positioning in proper registry, the reversible blades upon their respective supporting stems, each of the supporting stem is provided with stop element 90 as best shown in FIGS. 2, 7 and 8. The stop element provides for proper registry of the positioning screws through the holes in the support stem to secure the reversible blades to the stems when the screws are properly fastened within internally threaded openings in the reversible blades (not shown). A shoulder construction 92 on the stem as further acts as a stop and register for the blades.

Figure 4:
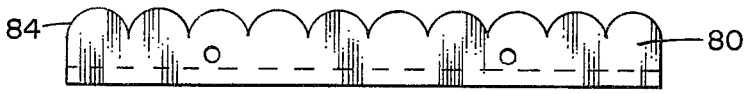
FIG. 4, is a view in side elevation of the blade of FIG. 3, showing a smaller scallop design.
Figure 5:
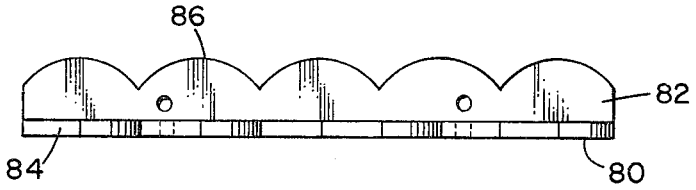
FIG. 5, is a view in side elevation with the blade turned to present the large scalloped design.
Figure 6:
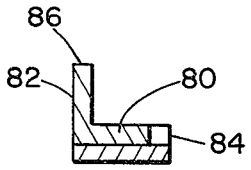
FIG. 6, is a view in section taken on the line 6—6 of FIG. 2.

The cutting relationship of the scissors shown in FIG. 2 is best shown in addition in FIGS. 5, and 7. In this relationship the large radius semi-circular design cutting edge 86 is shown in cutting relation for each of the cutting edges of the scissors. When the blades are reversed from this cutting position by turning the blades over 90° so that the previous cutting section becomes a base section and reversing the blades from top to bottom, the cutting edge 84, shown in FIGS. 4 and 8 is presented. This cutting edge has a smaller radius semi-circular design to present a smaller scalloped pinking section when the scissors are employed in this fashion. As previously mentioned, the reversible blades may be provided with separate designs as shown for the cutting edges 84 and 86 or additional designs may be employed from those generally indicated in FIGS. 1*a* through 1*g*. Alternately to prolong the life of the blade, the same pattern may be used on both cutting edges of each blade so that when one section becomes dull, the blades may be reversed to use the other section as the cutting edge of the reversible cutting blades.

Various changes and modifications may be made within this invention as will be readily apparent to those skilled in the art. Such changes and modifications are within the scope and teaching of this invention as defined by the claims appended hereto.

What we claim is:

1. Pinking scissors having replaceable blades for cutting multiple designs on the edge of sheet material, said scissors comprising a pair of pivotally connected cutting blade support stems provided with handle portions, means for attaching a reversible cutting blade to each of said stems, each of said blades being comprised of a first blade member connected at right angles to a second blade member to form a reversible cutting blade, said blade being supportable upon said stem with a first one of said blades acting as a base section and being secured in flush relation to an inner surface of the stem and a second of the blades extending at right angles thereto in cutting relation with a mating reversible cutting blade supported on the other support stem, the serrated edges of the first blade members carried by each stem meshing with each other to form a first serrated design, and said blades being reversible to present the second blades in cutting relation and the first blades acting as a base and being securable on the stems to provide a different serrated cutting pattern with the second blades.

2. The pinking scissors of claim 1, in which each of the blades has a base portion securable in flush relation to the support stem and screw means fitting through registering openings in the support stems and the blades for holding them in proper registry.

3. The pinking scissors of claim 1, in which the first and second blade members of each blade are rigidly connected together and stop means on the support stem provide registry of the blades with each other.

4. The pinking scissors of claim 3, in which said stop means comprises a shoulder on said supporting stem engageable with an end of the blade, a top of said shoulder being coterminous with a top surface of said base.

5. The pinking scissors of claim 1, in which said support stems form a bifurcated extension of said hand portions spaced apart from one another to accomodate said cutting blades.

6. The pinking scissors of claim 1, in which the width of each blade member is less than the width of the support stem in order that the blade member supported against the support stem is spaced interiorly of an outer edge of said blade member when not in use.

7. The pinking scissors of claim 3, in which said stop means comprises a flange means at the end of said support stem against which an end of the supported blade member abuts.

8. The pinking scissors of claim 1, in which said reversible cutting blade has a rigid L-shape.

* * * * *